US012129643B1

(12) United States Patent
Coleman

(10) Patent No.: US 12,129,643 B1
(45) Date of Patent: Oct. 29, 2024

(54) MONOLITHIC CONCRETE MODULAR CONNECTING PANEL SYSTEM FOR WALLS AND ROOFS AND RELATED METHODS

(71) Applicant: Robert Coleman, Winter Park, FL (US)

(72) Inventor: Robert Coleman, Winter Park, FL (US)

( * ) Notice: Subject to any disclaimer, the term of this patent is extended or adjusted under 35 U.S.C. 154(b) by 0 days.

(21) Appl. No.: 18/423,975

(22) Filed: Jan. 26, 2024

(51) Int. Cl.
*E04B 7/02* (2006.01)
*E04B 1/16* (2006.01)
*E04B 2/86* (2006.01)

(52) U.S. Cl.
CPC ..... *E04B 1/167* (2013.01); *E04B 1/161* (2013.01); *E04B 2/8605* (2013.01)

(58) Field of Classification Search
CPC ..... E04B 1/167; E04B 1/161; E04B 2/8605
See application file for complete search history.

(56) References Cited

U.S. PATENT DOCUMENTS 1,902,271 A * 3/1933 Warner ..... E04B 2/8605 52/390
3,885,296 A * 5/1975 Stout ..... E04B 5/48 52/577
4,125,981 A * 11/1978 MacLeod ..... E04B 1/161 52/351
4,674,242 A 6/1987 Oboler et al.
4,815,243 A 3/1989 Pardo
5,524,412 A 6/1996 Corl
5,592,848 A * 1/1997 Bodnar ..... E04B 1/161 29/415
5,799,453 A * 9/1998 Westerlund ..... E04B 1/161 52/250
5,845,441 A 12/1998 Swartz
6,519,904 B1 2/2003 Phillips
7,353,642 B1 * 4/2008 Henriquez ..... E04B 7/02 52/404.1
7,681,368 B1 3/2010 Rubio
8,733,048 B1 * 5/2014 Hanson ..... E04B 1/16 52/348
9,151,046 B1 10/2015 Francavilla
11,053,675 B1 * 7/2021 Santandreu ..... E04B 5/17
(Continued)

FOREIGN PATENT DOCUMENTS

EP 0106297 4/1984

*Primary Examiner* — Basil S Katcheves
(74) *Attorney, Agent, or Firm* — ALLEN, DYER ET AL.

(57) ABSTRACT

A monolithic concrete modular connecting panel system for walls and roofs includes a foundation for a building, wall panels vertically aligned on the foundation and secured to the foundation to form a perimeter of the building. The system includes a plurality of roof panels secured to a top edge of the wall panels and spanning across the perimeter of the building. A plurality of crisscrossing rebar rods and wire mesh within the wall panels and roof panels are connected together with rebar rods of the foundation to form a steel cage for the building. Each wall and roof panel includes a metal frame, and a concrete board that divides the metal frames into an inner section and an outer section. In addition, the system includes concrete sprayed on the outer sections of the wall panels and sprayed or poured on the roof panels to form a monolithic concrete structure.

16 Claims, 6 Drawing Sheets

(56) References Cited

U.S. PATENT DOCUMENTS

2007/0107341 A1* 5/2007 Zhu ..... E04B 1/161 52/309.12
2008/0016802 A1 1/2008 Rheaume
2008/0083181 A1* 4/2008 Ospina ..... E04B 1/24 52/336
2008/0295450 A1 12/2008 Yogev
2009/0200448 A1 8/2009 Edwards
2010/0319285 A1* 12/2010 Jewett ..... E04B 1/161 52/745.15
2011/0036046 A1* 2/2011 Henriquez ..... E04B 7/22 52/794.1
2011/0047928 A1* 3/2011 Aburto ..... E04B 1/161 52/745.05
2011/0225914 A1* 9/2011 Molfetta ..... E04B 1/161 52/309.1
2014/0075872 A1 3/2014 Mercado
2015/0113885 A1* 4/2015 Le Carpentier ..... E04B 1/3505 52/745.02
2016/0032587 A1 2/2016 Michaud et al.
2016/0122996 A1* 5/2016 Timberlake ..... E04B 1/161 52/742.14
2016/0298344 A1* 10/2016 Wang ..... E04G 11/365
2018/0112389 A1* 4/2018 Lake ..... E04B 1/4114
2019/0161964 A1* 5/2019 Figueroa ..... E04B 1/167
2020/0123761 A1* 4/2020 Garcia-Abril Ruiz .. E04B 1/167
2020/0232205 A1* 7/2020 Richmond ..... E04B 1/34823
2021/0071409 A1* 3/2021 Garcia-Abril Ruiz ..... E04B 2/8605

* cited by examiner

MONOLITHIC CONCRETE MODULAR CONNECTING PANEL SYSTEM FOR WALLS AND ROOFS AND RELATED METHODS

FIELD OF THE INVENTION

The present invention relates to building construction systems and more particularly to a monolithic concrete modular connecting panel system for walls and roofs and related methods.

BACKGROUND

Historically, the U.S. home building industry has been resistant to change. Builders continue to use older methods and refuse to transition to new alternative construction methods available. In a time when the frequency and intensity of natural disasters is escalating, replacement costs for each disaster is escalating too, due to inflation within the building and insurance industries. These costs will continue to skyrocket until action is taken to improve sustainability and improve construction methods while balancing costs.

Existing building methods include concrete block construction. This type of construction has been used for many years to build residential and commercial buildings. The blocks are stacked along the perimeter of the building on a concrete foundation and mortar is used to hold the concrete blocks together. This is a time consuming building method and requires skilled tradesmen for this type of construction.

Another method of using concrete in construction is the use of pre-cast concrete panels that can be formed off-site and trucked to the desired location for the building. This method can be more efficient than concrete block construction but still requires skilled labor, temporary shoring or framing and heavy equipment to position the pre-cast concrete panels, which increases costs.

The development of better building systems and methods for constructing low cost, efficient and easily built housing units has been slowed primarily by the need for skilled labor to assemble the components required for the construction. In many locales, skilled labor is in short supply and/or prohibitively expensive which has restricted the ability to construct low cost housing units en masse, particularly in underdeveloped countries. Other existing problems with existing construction systems include maintenance concerns, structural strength, and sufficient insulation from the elements.

Therefore, there is a need to further develop building construction systems and methods that are efficient, cost effective, structurally sound, and do not require significant amounts of skilled labor.

SUMMARY

A monolithic concrete wall and roof modular panel system is disclosed. The system includes a foundation for a building, where the foundation is reinforced with rebar rods (whether graded or ungraded) also referred to herein as rebar. The system also includes a plurality of wall panels vertically aligned on the foundation and having a bottom edge secured to the foundation to form a perimeter of the building, and a plurality of roof panels secured to a top edge of the plurality of wall panels and spanning across the perimeter of the building. The system also includes a plurality of crisscrossing rebar rods within the plurality of wall panels and the plurality of roof panels, which are connected together with the rebar rods of the foundation to form a steel rebar cage for the building. In addition, the system includes concrete sprayed on the plurality of wall panels and concrete sprayed or poured on the plurality of roof panels forming a monolithic structure.

Each wall panel comprises a wall metal frame, and each roof panel comprises a roof metal frame. Also, a concrete board divides the respective wall metal frame into an inner section and an outer section, and a concrete board divides the roof metal frame into an inner section and an outer section. A sheet of wire mesh is also positioned within the outer section of each of the wall panels and each of the roof panels to diminish cracking of the concrete and to improve the flexural strength of the concrete. In addition, a plurality of connecting apertures may be formed in the outer section of the wall metal frame and configured as a channel of pathways for concrete to flow between adjacent wall metal frames to join or connect wall panels in order to form a monolithic wall structure. Similarly, a plurality of connecting roof apertures may be formed in the outer section of the roof metal frame and configured to form a pathway for concrete to flow between adjacent roof metal frames and form a monolithic roof structure. The monolithic roof structure is structurally connected by the rebar to the monolithic wall structure, which in turn is structurally connected by rebar to the foundation forming a rebar cage for the building.

In a particular aspect, a depth of the wall metal frame is approximately eight inches, and a depth of roof metal frame is approximately eight inches. The wall metal frame may be approximately four feet in width and ten feet in height, and the roof metal frame may be approximately two feet in width and twenty feet in length. The spacing of the plurality of crisscrossing rebar rods may be approximately twelve inches on center. Also, connectors may be used to connect adjacent metal wall frames and metal roof frames together.

In another particular aspect, a monolithic concrete modular panel is disclosed. The panel includes a metal frame having a plurality of rebar apertures, a concrete board dividing the metal frame into an inner section and an outer section, a sheet of wire mesh positioned within the outer section, a plurality of crisscrossing rebar rods within the metal frame aligned with the plurality of rebar apertures, and a plurality of connecting apertures are formed in the outer section of the wall metal frame and configured to form a pathway for concrete to flow between adjacent metal frames and form a monolithic structure.

In another aspect, a method of constructing a building using a monolithic concrete modular panel system for walls and roofs is disclosed. The method includes installing a foundation for a building, and securing a bottom edge of a plurality of wall panels vertically on the foundation to form a perimeter of the building. The plurality of wall panels have a concrete board dividing the wall panel into an outer section and an inner section. The method also includes securing a plurality of roof panels to a top edge of the plurality of wall panels and spanning across the perimeter of the building. The plurality of roof panels have a concrete board dividing the roof panel into an outer section and an inner section. In addition, the method includes connecting together rebar within the foundation to vertical rebar of a plurality of crisscrossing rebar rods within the outer sections of the plurality of wall panels to the plurality of roof panels to form a steel cage for the building, and spraying concrete on the outer sections of the plurality of wall panels and spraying or pouring concrete on the plurality of roof panels forming a monolithic structure.

BRIEF DESCRIPTION OF THE DRAWINGS

The above objects, as well as additional objects, features and advantages of the present invention, will be more fully appreciated by reference to the following illustrative and non-limiting detailed description of embodiments of the present invention, when taken in conjunction with the accompanying drawings, wherein.

DETAILED DESCRIPTION

In the present detailed description, embodiments of the present invention will be discussed with the accompanying figures. It should be noted that this by no means limits the scope of the invention, which is also applicable in other circumstances for instance with other types or variants of methods other than the embodiments shown in the appended drawings. Further, that specific features are mentioned in connection to an embodiment of the invention does not mean that those components cannot be used to an advantage together with other embodiments of the invention.

The monolithic concrete wall and roof modular panel system and methods of the invention are directed to an affordable alternative modular building solution packaged for homeowners and contractors. This includes replacing traditional wood structures, especially engineered roofing structures.

The system comprises monolithic concrete/steel reinforced modular panels having mesh and rebar positioned internally to achieve maximum strength and durability. This forms the modular shell structure, a true "SIPS" (Structural Integrated Panel System). Once the roofing and wall panels or sections thereof are assembled on site, each panel is filled with high-density psi concrete using the shotcrete method for the wall panels and sprayed or poured for the roof panels. The concrete is finished to a smooth texture, waterproofed, and sealed. This engineering combines the most advanced sustainable cutting-edge construction technologies, resisting the test of time for generations in most catastrophic related occurrences such as hurricanes, tornadoes, wildfires, and earthquakes.

Figure 1:
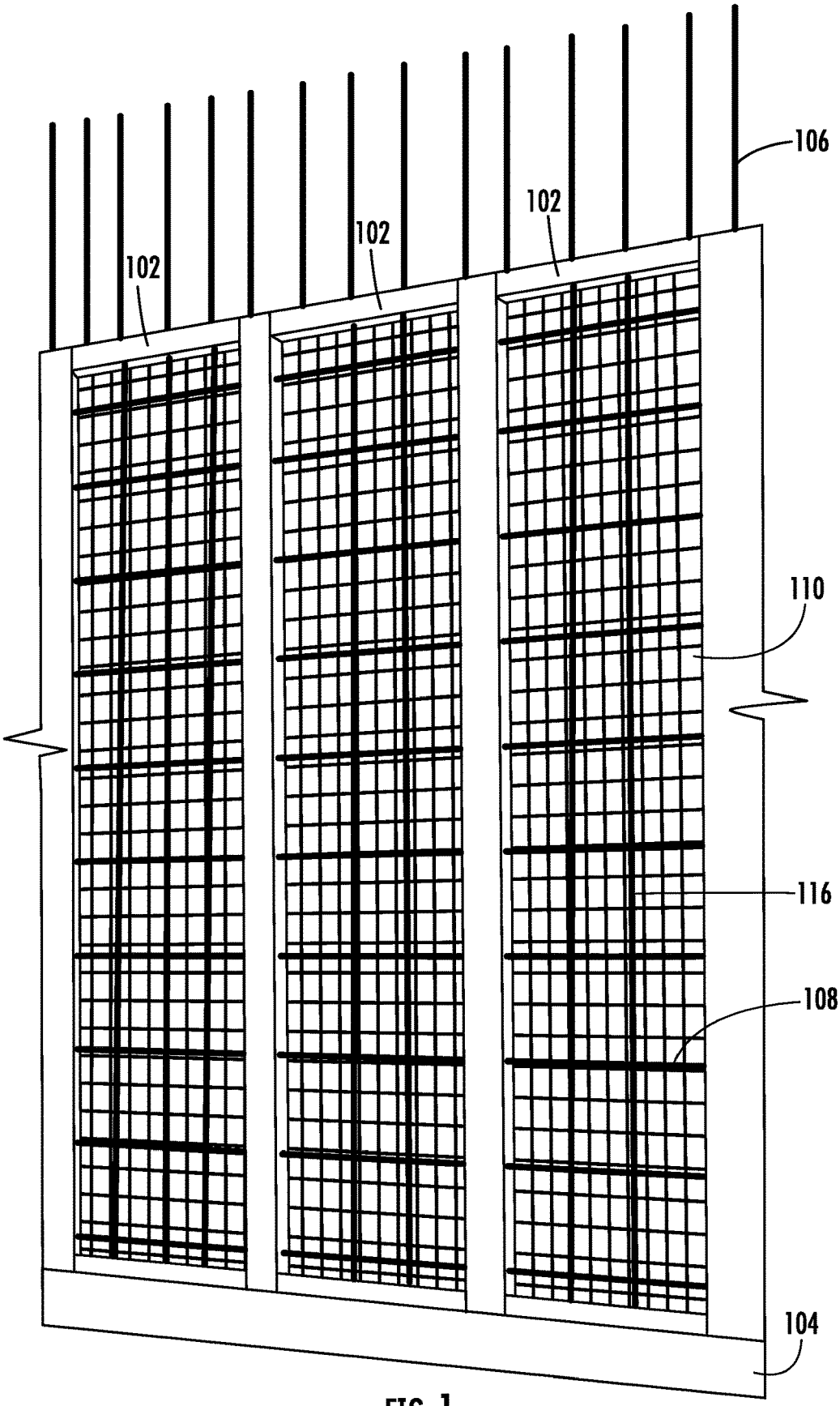
FIG. 1 is a perspective view of an outer section of a wall panel in which various aspects of the disclosure may be implemented.

Referring now to FIG. 1, a plurality of wall metal frames 102 are depicted forming a wall section on a foundation 104 as described above. Each of the wall metal frames 102 will be sprayed with concrete to form a finished wall panel 100. A concrete board 110 divides the wall metal frames 102 into an outer section and an inner section. The outer section of each wall metal frame 102 includes a sheet of wire mesh 116 adjacent to the concrete board 110 and a network of vertical rebar 106 and horizontal rebar 108.

Figure 2:
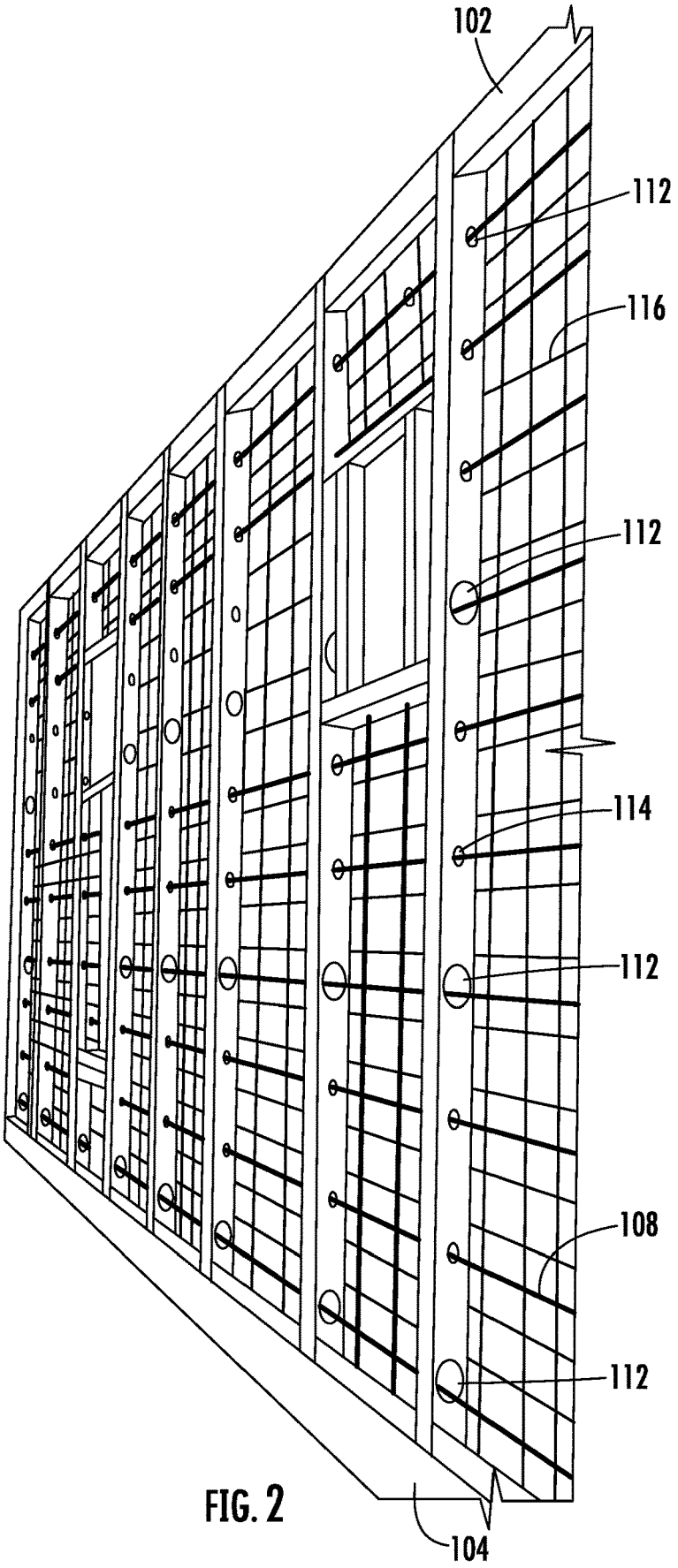
FIG. 2 is a perspective view of a wall section formed by a plurality of wall panels of the present invention.

A view of the wall section of a plurality of wall metal frames 102 is depicted in FIG. 2. The wall metal frames 102 include connecting apertures 112 in the respective vertical members. This allows concrete to flow between the adjacent wall metal frames 102 to merge and cure to form a monolithic concrete wall section.

Accordingly, the building structures assembled using the system and methods described herein offer economical savings and many of the benefits desired by most homeowners. These features include energy efficiency, lowering of insurance premiums, preventing mold or termites, low-cost maintenance, and more. In addition, the wall panels 100 and roof panels 120 meet standards implemented by Green Coalition and LEED specifications. The system and methods also give builders the flexibility to construct temporary housing, single and multi-family residences, permanent safe rooms, and safe commercial buildings.

The construction system and methods are based on the strength and durability of monolithic concrete because the structures are built as a single uniform unit, using rebar reinforcement to give it greater structural strength. The comprehensive strength of poured concrete walls is several times that of block walls. Additionally, high-tech insulation with a high R-value for energy savings may be placed within each panel creating an airtight seal.

Figure 3:
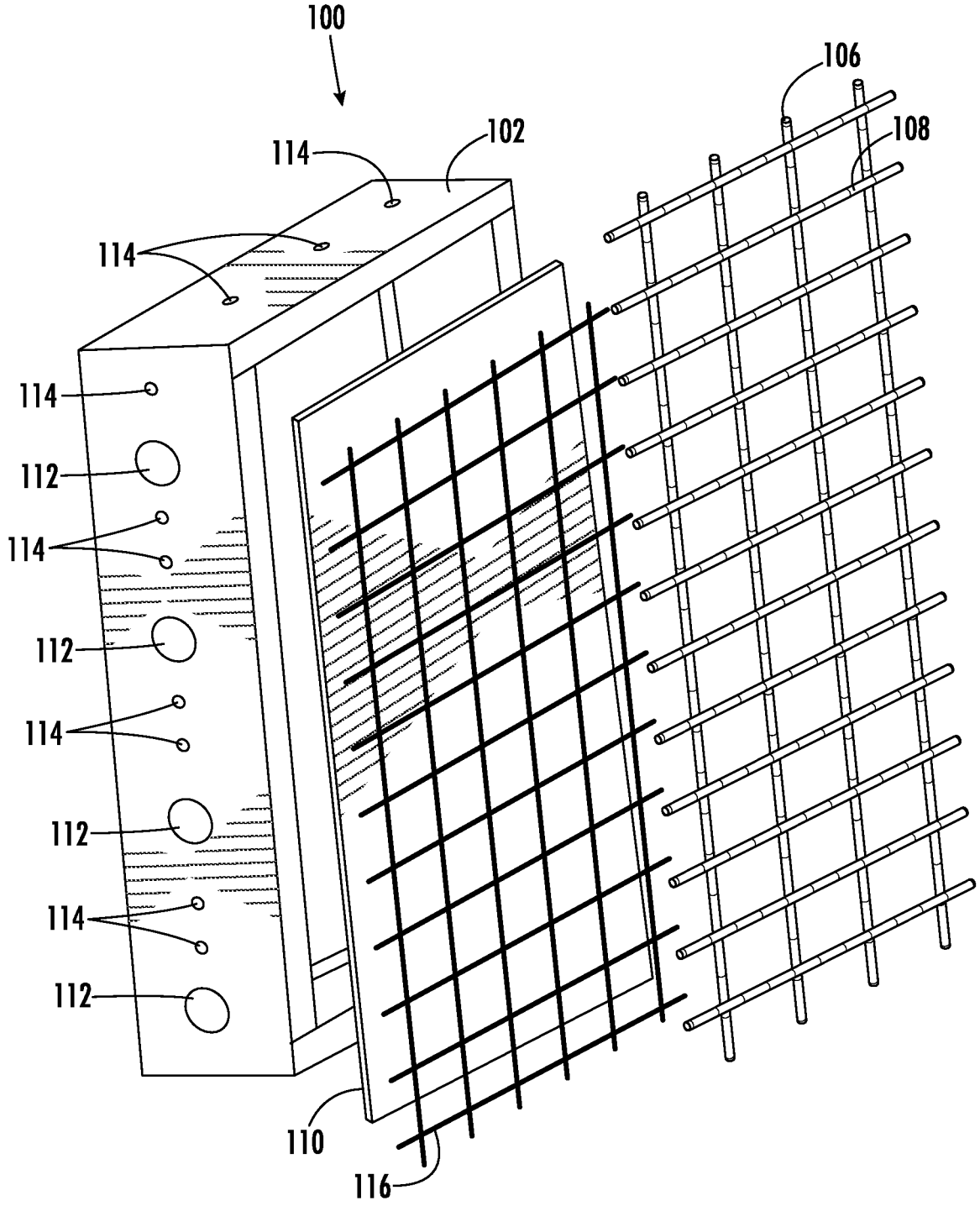
FIG. 3 is an exploded perspective view of the wall panel shown in FIG. 1.

Referring now to FIG. 3, an exploded view of a wall panel 100 is depicted without the concrete for clarity. The wall metal frame 102 is generally rectangular in shape and configured to receive a similar shaped concrete board 110 therein. The wall metal frame 102 may be welded or spot welded together, or held together with fasteners, or with bolts and locks, as those of ordinary skill in the art can appreciate. A sheet of wire mesh 116 is interposed between the concrete board 110 and the rebar 106, 108 to diminish cracking of the concrete and to improve the flexural strength of the concrete. The connection apertures 112 along the vertical member of the wall metal frame 102 are visible and match to complementary connection apertures on an adjacent wall metal frame. A plurality of rebar apertures 114 are also visible along both the vertical and horizontal members of the wall metal frame 102. This allows for rebar 106, 108 to pass continuously without interruption to adjacent wall and roof panels and structurally connect them together to form a steel cage of the building that is covered with concrete.

In various strength tests, reinforced concrete proved two to four times stronger than the maximum wind load and five to nine times stronger than the maximum earthquake load bending strength under the Uniform Building Code. Thus, the strength of concrete is considerably greater than the standards required to be resistant to most catastrophic conditions.

In particular, the construction system and methods described herein are designed to resist and withstand most weather-related conditions with minimal damage, including hurricane force winds, providing a "safe haven" during storms where evacuation is not mandatory. This is consistent with Federal Emergency Management Agency (FEMA) who is promoting the concept of building homes to weather the storm in areas where evacuation is not mandatory. Many homebuilders are currently promoting the construction of integrated safe rooms in homes so that there is at least one small area of safety for occupants to weather the storm.

In countless firewall tests, concrete has also proven itself as one of the most fire and heat-resistant construction materials. Unlike wood or steel, concrete does not burn, soften, or bend. Concrete structures are most likely to remain standing through a fire, not susceptible to damage by insects and termites that can cost thousands of dollars to treat or repair, and of course, not susceptible to wood rot.

The monolithic concrete modular building system and methods of the invention have similar costs compared with the traditional wood building process but offers many added benefits. For example, maintenance and upkeep are virtually nonexistent with homes constructed using the system and methods described herein which will offer homeowners longevity and substantial savings over time.

The present construction system and methods can be used with most any architectural design, giving homeowners and builders the flexibility to build most any floor plan or roofing style desired. In addition, the system and methods allow builders to choose many different exterior cosmetic finishes for facades and roofs to conform to local design standards. Stucco, brick, fiber concrete siding or stone, as well as other siding materials, may be used on the exterior concrete finished walls and slate, tile, shingle, metal or other roof materials can be used on the concrete finished roof.

Figure 4:
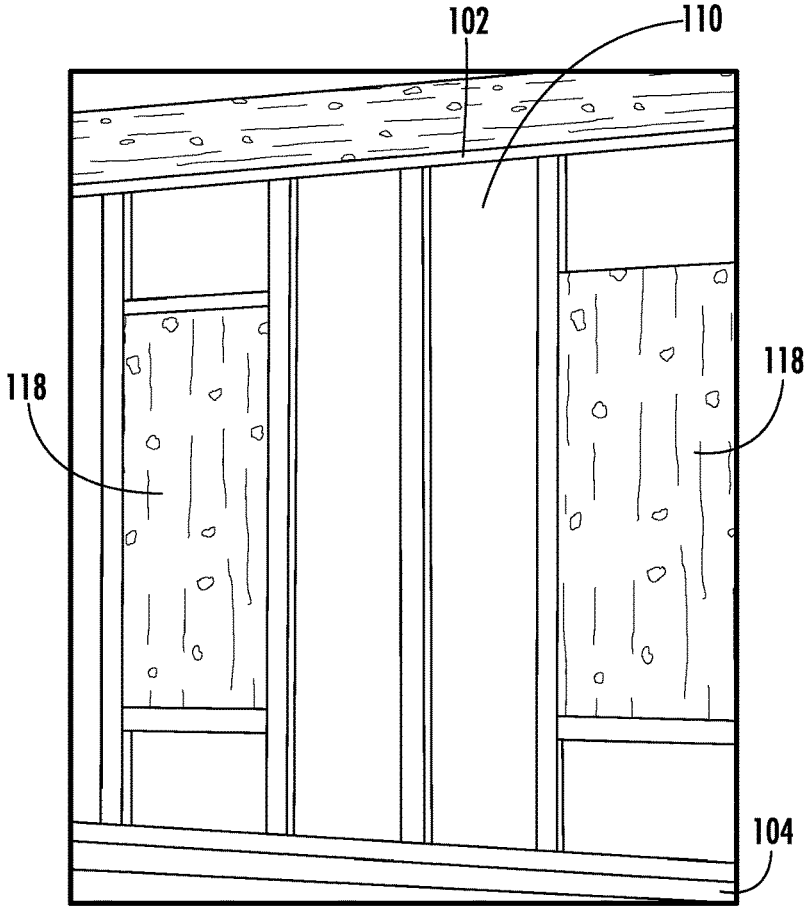
FIG. 4 is a perspective view of an inner section of a wall panel.

Also, the inner section of the wall metal frame 102, as depicted in FIG. 4 for example, includes open space that can be used for insulation or electrical and plumbing conduit. The inner section can be covered in drywall or other desired material as in standard construction. Door and window openings 118 can also be configured within the wall sections.

Figure 5:
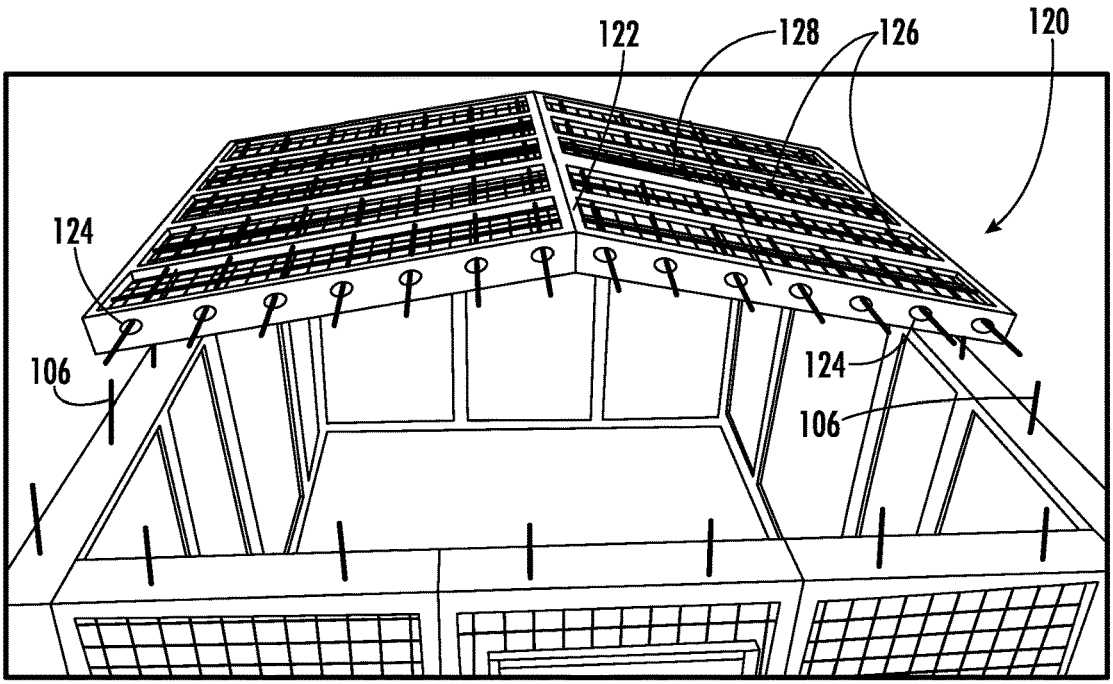
FIG. 5 is a top perspective view of a building having the wall panels assembled, and roof panels of the present invention partially installed on the building.
Figure 6:
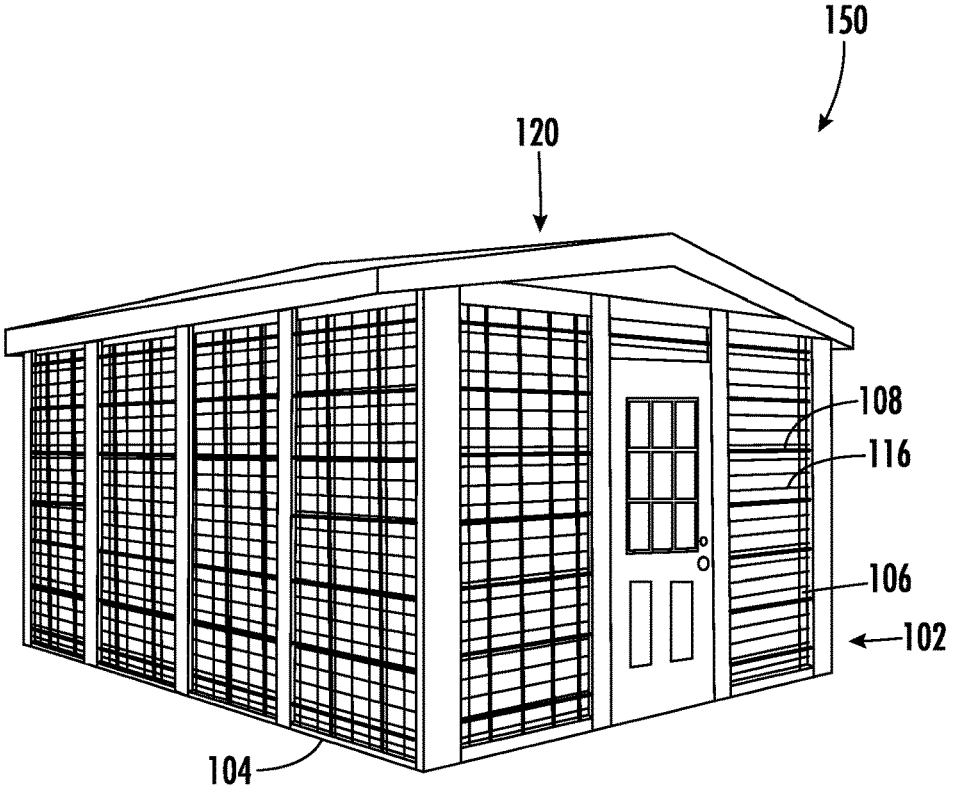
FIG. 6 is a perspective view of the building of FIG. 5 having the wall panels and roof panels installed prior to concrete being applied.
Figure 7:
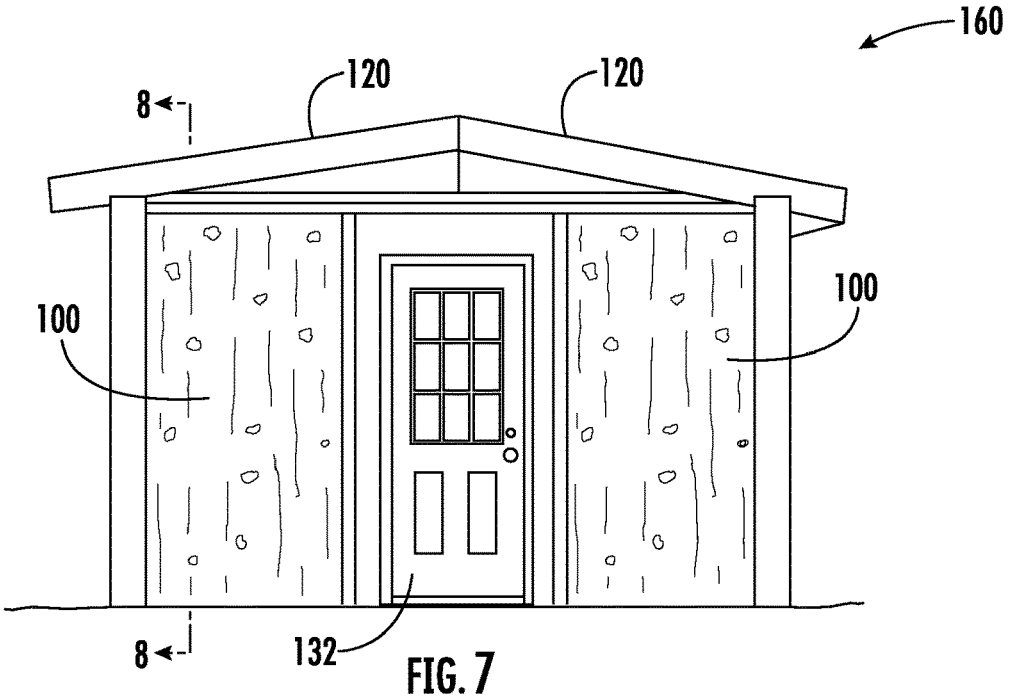
FIG. 7 is a front view of the building of FIG. 6 after the concrete has been applied to the wall and roof panels and ready for application of cosmetic finishes.

Referring now to FIG. 5, the monolithic concrete modular panel system for the roof panels 120 is the same process used in the walls. The monolithic structure provides rigidity and eliminates weak structural connections and water intrusion issues. The roof panels 120 are joined together at the peak 122 and span across from one wall section to another. The roof panels 120 also include connecting apertures 124 that allow concrete to flow to adjacent roof panels and cure to form a monolithic concrete roof structure. The roof panels 120 include continuous rebar 126, 128 to reinforce each roof panel and connect across the apex of the roof as well to connect to the rebar from the wall panels 100 to form the steel rebar cage of the building 150 as shown in FIG. 6. Concrete is sprayed using the shotcrete method to fill the respective outer sections of the wall panels 100 and concrete can be poured or sprayed on the roof panels 120, as shown in FIG. 7, to complete the building 160. A door 132 or garage doors can be framed within the wall sections as in standard construction.

Each wall panel 100 includes the wall metal frame 102 comprising a galvanized or cold rolled steel wrap of rectangle angled turned C-channel. The wall panels 100 are connected to the footers 104 forming the flooring slab, and covers the exterior of most any size square footage of residence or other building.

Figure 8:
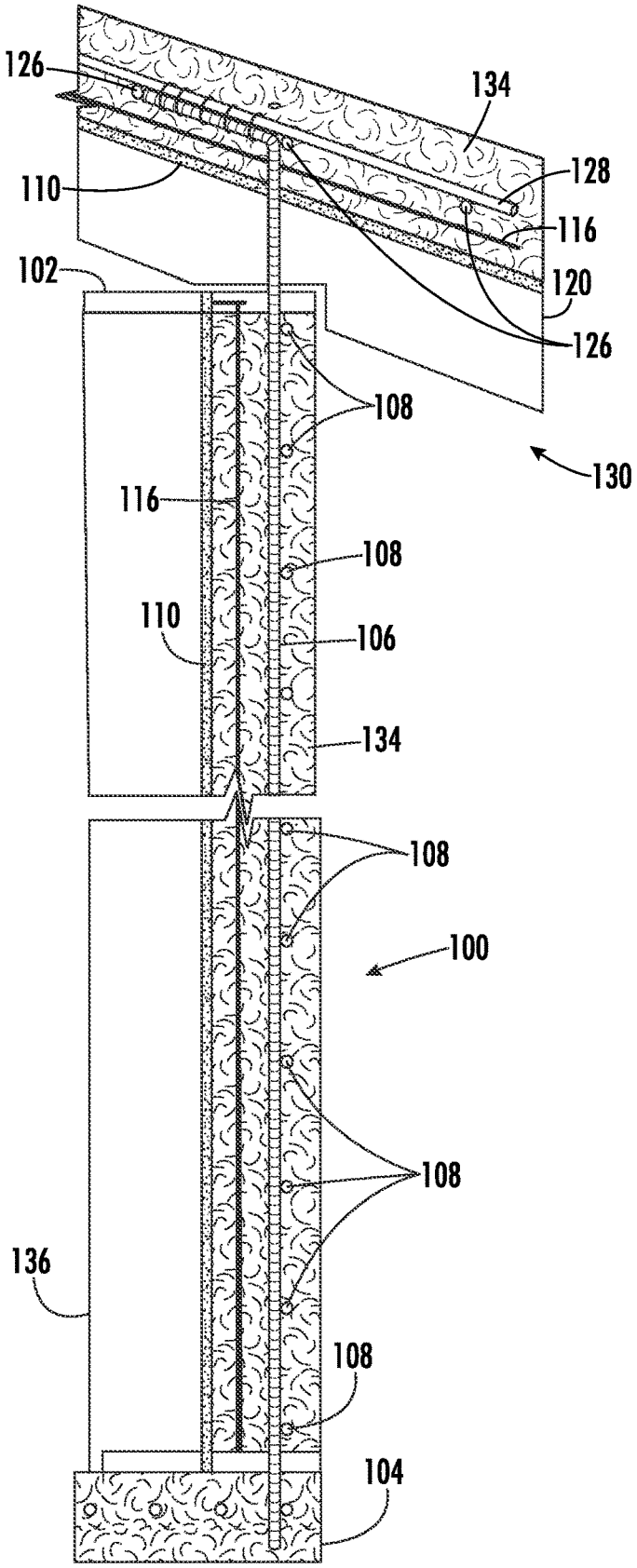
FIG. 8 is a cross sectional view of the wall and roof panels taken along the line 8-8 of FIG. 7.

Referring now to FIG. 8, a cross sectional view of the wall panel 100 and roof panel taken along the line 8-8 of FIG. 7 is depicted. Once installed on the foundation 104, the wall metal frames 102 have concrete 134 applied using the shotcrete method of up to 4 inches thick over a network of rebar 106, 108 comprising a 12-inch span of vertical and a 12-inch span of horizontal crisscrossing rebar rods that are positioned within each wall panel. In addition, the sheet of wire mesh 116 is positioned behind the network of rebar 106, 108 to diminish cracking of the concrete and to improve the flexural strength of the concrete. Further, the exterior face of the concrete receives a smooth concrete finish.

As described above, the roof panels 120 have a similar or identical construction to the wall panels 100. The rebar 126, 128 of the roof panels 120 are structurally connected to the wall panels 100 making a continuous steel cage from one side to the other side of the structure. Subsequently, the concrete 134 is applied by pouring or using the shotcrete method to the roof panels 120 of up to 4 inches thick with a smooth finish surface.

In a particular aspect, the metal wall frame 102 of the wall panels 100 comprises 8 inch wide steel C-channel, made of 14 gauge galvanized steel. The sides of the wall metal frame 102 include drilled rebar holes/apertures 114 and connecting apertures 112 for continuous channels of rebar and concrete. The wall metal frame 102 may also comprise cold rolled steel, and different gauge such as 12 gauge, for example. In addition, the wall metal frame 102 may be six or ten inches in width in particular aspects.

The thickness or depth of the wall (and roof metal) frame 102 is divided in half by the concrete board 110 so that an outer section and an inner section are formed within the wall metal frame 102. Half-inch, No. 4, rebar, for example, is crisscrossed horizontally 108 and vertically 106 every twelve inches within the wall metal panel 102 through the rebar apertures 114 in the wall metal frame 102. In addition, the quarter-inch steel sheet of wire mesh 116 is placed in the center of the outer section of the wall metal frame 102. The wall metal frame 102 is then filled with approximately four inches of concrete 134 using the shotcrete method, and finished to a smooth exterior glaze.

The typical wall panel 100 is four feet wide and ten feet in height. The typical roof panel 120 is two feet wide and twenty feet in length. The adjacent roof 120 and wall panels 100 are connected together with rebar and with or without one half inch bolts and locks, for example. Once the concrete 134 is applied by shotcrete into the wall panels 100 and poured or applied by shotcrete into the roof panels 120, they are monolithically and modularly joined together.

A method of constructing a building using the monolithic concrete modular panel system for walls and roofs described above can be accomplished without the use of significant amounts of skilled labor. For example, the method includes installing the foundation 104 for the building, and securing a bottom edge of the plurality of wall panels 100 vertically on the foundation 104 to form a perimeter of the building. The plurality of wall panels 100 have a concrete board 110 dividing the wall panel into an outer section and an inner section. The method also includes securing a plurality of roof panels 120 to a top edge of the plurality of wall panels 100 and spanning across the perimeter of the building. The plurality of roof panels 120 also have a concrete board 110 dividing the roof panel 120 into an outer section and an inner section. In addition, the method includes using ties for connecting together a plurality of crisscrossing rebar rods 106, 108, 126, 128 within the outer sections of the plurality of wall panels 100 and the plurality of roof panels 120 to form a steel cage for the building, and spraying concrete 134 on the outer sections of the plurality of wall panels 100 and spraying or pouring the plurality of roof panels 120 forming a monolithic structure. The building can then be finished with the desired exterior and interior finishes that are standard in the construction industry.

Many modifications and other embodiments will come to the mind of one skilled in the art having the benefit of the teachings presented in the foregoing descriptions and the associated drawings. Therefore, it is understood that the disclosure is not to be limited to the specific embodiments disclosed, and that modifications and embodiments are intended to be included within the scope of the appended claims.

That which is claimed is:

1. A monolithic concrete modular panel system for walls and roofs, the system comprising:

a foundation for a building, wherein the foundation comprises concrete reinforced with rebar rods;

a plurality of wall panels vertically aligned on the foundation and having a bottom edge secured to the foundation to form a perimeter of the building;

a plurality of roof panels secured to a top edge of the plurality of wall panels and spanning across the perimeter of the building, wherein the plurality of wall panels and roof panels having a plurality of connecting apertures;

a plurality of horizontal and vertical crisscrossing rebar rods within the plurality of wall panels and the plurality of roof panels that pass through the plurality of connecting apertures and connect together with the rebar rods of the foundation to anchor a continuous skeletal steel rebar cage wrapping the building, wherein the continuous skeletal steel rebar cage comprises the rebar rods of the foundation on a first side of the building anchored to the rebar rods running up the plurality of wall panels on the first side, to the rebar rods running across the plurality of roof panels through a ridge and eaves of a roof, to the rebar rods running back down an opposing second side of the building, and to the rebar rods of the foundation on the opposing second side;

a concrete board dividing each of the wall and roof panels into an inner section and an outer section;

a sheet of wire mesh positioned within the outer section; and concrete filling the outer section of a respective wall panel on one side of the concrete board and the inner section on the opposing side of the concrete board comprising open space within the respective wall panel, and concrete filling the outer sections of the plurality of roof panels forming monolithic reinforced concrete structures;

wherein the outer sections of the plurality of wall and roof panels have reinforced concrete passing through the plurality of connecting apertures that connect adjacent wall and roof panels together.

2. The system of claim 1, wherein each wall panel comprises a wall metal frame, and each roof panel comprises a roof metal frame.

3. The system of claim 2, wherein a depth of the wall metal frame is approximately eight inches.

4. The system of claim 2, wherein a depth of roof metal frame is approximately eight inches.

5. The system of claim 2, wherein the wall metal frame is approximately four feet in width and ten feet in height.

6. The system of claim 2, wherein the roof metal frame is approximately two feet in width and twenty feet in length.

7. The system of claim 2, further comprising connectors that connect adjacent metal wall frames and metal roof frames together.

8. The system of claim 1, further comprising a sheet of wire mesh positioned within the outer section of each of the wall panels and each of the roof panels.

9. The system of claim 1, wherein the spacing of the plurality of crisscrossing rebar rods is approximately twelve inches on center.

10. A monolithic concrete modular panel for a building, the panel comprising:

a metal frame having a plurality of web apertures;

a concrete board dividing the metal frame into an inner section and an outer section;

a sheet of wire mesh positioned within the outer section;

a plurality of horizontal and vertical crisscrossing rebar rods within the outer section of the metal frame configured to be aligned with the plurality of apertures of an adjacent metal frame to form a continuous skeletal steel rebar cage wrapping the building, wherein the continuous skeletal steel rebar cage is configured to be formed by a plurality of rebar rods of a foundation on a first side of the building anchored to the plurality of rebar rods running up the metal frame on the first side, to a plurality of rebar rods running across a plurality of roof panels through a ridge and eaves of a roof, to a plurality of rebar rods running back down a metal frame on an opposing second side of the building, and to the plurality of rebar rods of the foundation on the opposing second side; and wherein the outer section of the metal frame is configured to have reinforced concrete passing through the plurality of apertures to connect to an adjacent metal frame.

11. The monolithic concrete modular panel of claim 10, wherein the outer section of the metal frame is configured to receive concrete therein to form the monolithic structure.

12. The monolithic concrete modular panel of claim 11, wherein the panel may be used for a wall section or a roof section for a building.

13. The monolithic concrete modular panel of claim 12, wherein a depth of the metal frame is approximately eight inches.

14. The monolithic concrete modular panel of claim 13, wherein the metal frame is approximately four feet in width and ten feet in height when used for the wall section.

15. The monolithic concrete modular panel of claim 14, wherein the metal frame is approximately two feet in width and twenty feet in length when used for the roof section.

16. A method of constructing a building using a monolithic concrete modular connecting panel system for walls and roofs, the method comprising:

installing a foundation for a building, wherein the foundation comprises concrete reinforced with rebar rods;

securing a bottom edge of a plurality of wall panels vertically on the foundation to form a perimeter of the building, wherein the plurality of wall panels have a concrete board dividing the wall panel into an outer section and an inner section;

securing a plurality of roof panels to a top edge of the plurality of wall panels and spanning across the perimeter of the building, wherein the plurality of roof panels have a concrete board dividing the roof panel into an outer section and an inner section, and wherein the plurality of wall panels and roof panels have a plurality of connecting apertures;

connecting together the rebar rods within the foundation to vertical rebar of a plurality of horizontal and vertical crisscrossing rebar rods within the outer sections of the plurality of wall panels and the plurality of roof panels to form a continuous skeletal steel rebar cage wrapping the building, wherein the continuous skeletal steel rebar cage comprises the rebar rods of the foundation on a first side of the building anchored to the rebar rods running up the plurality of wall panels on the first side, to the rebar rods running across the plurality of roof panels through a ridge and eaves of a roof, to the rebar rods running back down an opposing second side of the building, and to the rebar rods of the foundation on the opposing second side; and spraying concrete on the outer sections of the plurality of wall panels and spraying or pouring concrete on the plurality of roof panels forming a monolithic structure;

wherein the outer sections of the plurality of wall and roof panels have reinforced concrete passing through the plurality of connecting apertures that connect adjacent wall and roof panels together.

* * * * *